United States Patent [19]

Berthold

[11] 4,422,367

[45] Dec. 27, 1983

[54] AXIAL PISTON MACHINE HAVING INCLINED AXIS CONSTRUCTION WITH SWIVEL CARRIAGE AND ADJUSTING ARRANGEMENT

[75] Inventor: Heinz Berthold, Bildechingen, Fed. Rep. of Germany

[73] Assignee: Brueninghaus Hydraulik GmbH, Fed. Rep. of Germany

[21] Appl. No.: 292,521

[22] Filed: Aug. 13, 1981

[30] Foreign Application Priority Data

Aug. 13, 1980 [DE] Fed. Rep. of Germany ..... 3030637

[51] Int. Cl.[3] ..... F01B 13/04

[52] U.S. Cl. ..... 91/484; 91/506

[58] Field of Search ..... 91/504, 505, 506, 484; 47/222; 92/12.1

[56] References Cited

U.S. PATENT DOCUMENTS

| | | | |
|---|---|---|---|
| 3,233,555 | 2/1966 | Wahlmark | 91/506 |
| 3,589,244 | 6/1971 | Pruvot | 91/504 |
| 4,198,899 | 4/1980 | Forster | 91/505 |

FOREIGN PATENT DOCUMENTS

| | | | |
|---|---|---|---|
| 1017468 | 1/1953 | Fed. Rep. of Germany . | |
| 1775222 | 7/1968 | Fed. Rep. of Germany . | |
| 2643770 | 4/1977 | Fed. Rep. of Germany | 91/505 |
| 2647139 | 4/1978 | Fed. Rep. of Germany | 91/505 |
| 955878 | 7/1949 | France | 91/505 |
| 2037879 | 7/1980 | United Kingdom | 91/505 |
| 723211 | 3/1980 | U.S.S.R. | 91/506 |

*Primary Examiner*—William L. Freeh

*Attorney, Agent, or Firm*—Scully, Scott, Murphy & Presser

[57] ABSTRACT

An axial piston machine having an inclined axis construction, including a cylinder drum pivotally arranged within a housing, and a swivel carriage located opposite to the cylinder drum and which is supported in a sliding guide, which contains the control surface as well as the reniform control recesses on the pressure and suction sides and connects these with, respectively, a pressure or suction passageway communicating in one of the sliding guide surfaces. Included is an adjusting arrangement for setting the angular position of the cylinder drum, consisting of a displaceable setting element arranged on the housing generally in parallel with the drive shaft and of an angle lever supported in the housing so as to be pivotable about the swivel axis of the cylinder drum, whose first lever arm is articulated on the setting element and whose second lever arm engages on the swivel carriage.

11 Claims, 11 Drawing Figures

PMW
PKRD
PKAX
PRK

FIG. 10
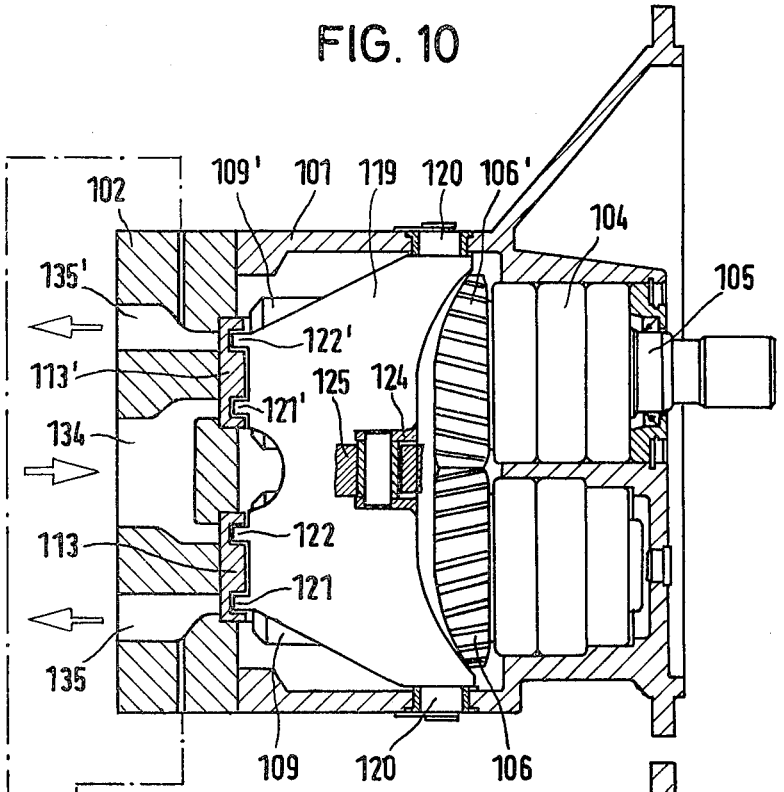
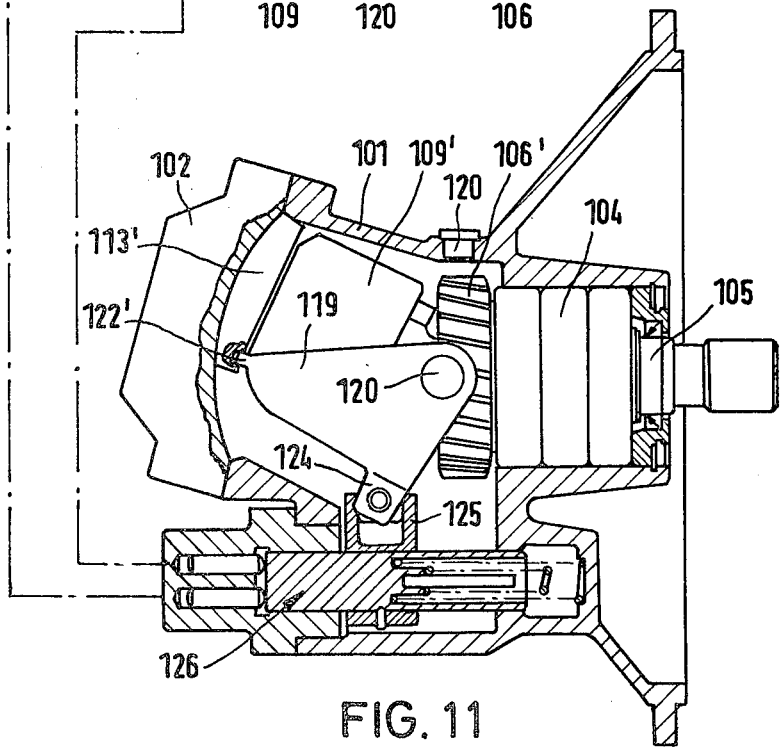
FIG. 11

AXIAL PISTON MACHINE HAVING INCLINED AXIS CONSTRUCTION WITH SWIVEL CARRIAGE AND ADJUSTING ARRANGEMENT

BACKGROUND OF THE INVENTION

1. Field of the Invention

The present invention relates to an axial piston machine having an inclined axis construction, including a cylinder drum pivotally arranged within a housing, and a swivel carriage located opposite to the cylinder drum and which is supported in a sliding guide, which contains the control surface as well as the reniform control recesses on the pressure and suction sides and connects these with, respectively, a pressure or suction passageway communicating in one of the sliding guide surfaces, as well as with an adjusting arrangement for setting the angular position of the cylinder drum, consisting of a displaceable setting element arranged on the housing generally in parallel with the drive shaft and of an angle lever supported in the housing so as to be pivotable about the swivel axis of the cylinder drum, whose first lever arm is articulated on the setting element and whose second lever arm engages on the swivel carriage.

2. Discussion of the Prior Art

In axial piston machines which provide for a construction having an inclined axis with a swivel carriage movable through the intermediary of an adjusting arrangement for adjusting the angular position of the cylinder drum, the adjusting arrangement is located within a closure plate at the end surface of the housing of the axial piston machine, as can be ascertained from German Pat. No. 1,017,468. Special measures are required in order to avoid a canting of the swivel carriage within the sliding guide of the connector plate and the therewith attendant high friction forces and resultant displacement forces. Of necessity, the adjusting arrangement within the connector plate is bulky since the entire path of adjustment of the swivel carriage must be traversed by at least portions of the adjusting arrangement, in other words, there is no possibility of conversion of the adjusting movement. A further problem which is encountered consists in the configuration of the connector plate which, in addition to the adjusting arrangement, must incorporate the pressure and suction passageways for the operating fluid. This leads to the fact that the connector plate is a relatively complicated, large and consequently expensively produceable component.

Adjusting arrangements which are not located in a connector plate but otherwise within the machine housing, and which engage sideways to the swivel carriage, are known, for example, from German Laid-open Patent Application No. 2 643 770. The adjusting rod projecting sideways, which engages on the swivel carriage, renders the overall machine construction bulky.

The axial piston machine of the above-mentioned type which has become known from German Laid-open Patent Application No. 1 775 222 has an adjusting arrangement which includes a displaceable setting element located on the housing generally in parallel with the drive shaft, and an angle lever supported in the housing so as to be pivotable about the swivel axis of the cylinder drum, whose first lever arm is articulated to the setting element and whose second lever arm engages on the swivel carriage. Afforded thereby is a satisfactory spatial distribution for the overall construction of the machine, and through the angle lever there is facilitated a reduction in the path of the swivel carriage on the adjusting arrangement or, respectively, the setting element. A smaller constructed adjusting arrangement can thus be provided. However, it is disadvantageous in this known construction that the second lever arm of the angle lever which engages on the swivel carriage engages on one side of the swivel carriage as viewed in the pivot direction of the pivot carriage, so that a canting of the swivel carriage within the sliding guide cannot be avoided. Such a canting is also not avoided by an arrangement of two angle levers located on opposite sides since the swivel carriage is not uniformly loaded by the operating fluid (pressure side and suction side) and this non-uniform loading lies transverse to the pivoting direction of the swivel carriage.

SUMMARY OF THE INVENTION

Accordingly, it is an object of the present invention to facilitate through simple constructive means a displacement of the swivel carriage which is not subject to canting and requires only a small force.

For the attainment of this object there is inventively proposed in an axial piston machine of the above-mentioned type that the second lever arm in the area of the forward side of the swivel carriage in the direction of pivoting engages on the latter asymmetrically at a point located externally of the pivotal median plane, which lies in the plane of the resultant friction forces acting opposite to the displacement force on the swivel carriage.

The invention is based on the recognition that acting on the swivel carriage are not only pressure forces on the sliding guide in the housing or on a connector plate, but due to the spherical construction of the control surface, also forces acting sideways transverse to the pivoting direction, which press the swivel carriage against the side bounding surface of the sliding guide. Through the inventive articulation of the angle lever on the swivel carriage there is now effected the movement along of the swivel carriage during a setting movement precisely in the plane in which there is produced the resultant friction force between the swivel carriage and its sliding guide. Hereby are avoided tipping forces which can lead to a canting of the swivel carriage within the sliding guide (sliding drawer effect). Correspondingly, lower setting forces can be applied and the adjusting arrangement can be designed lighter and smaller in comparison with previous adjusting arrangements which engage symmetrically on the swivel carriage.

In order to achieve a further reduction of the friction forces, in a further embodiment of the invention there is proposed that for the compensation of forces acting on the swivel carriage transverse to the pivoting direction, there be located in the side surface on the side of the suction recess parallel to the pivot plane, a pressure area which is located opposite a side guide surface of the sliding guide of the swivel carriage within the housing, which is connected with the high pressure control recesses through passageways in the swivel carriage.

A further advantageous embodiment of the invention is characterized in that the second lever arm includes its free end two follower fingers equally sized in their cross-sectional dimensions, and wherein the swivel carriage in the region of forward and rearward side of the pivot direction respectively two adjacent located apertures symmetrical relative to the pivoting center plane, into which there engage the follower fingers, and of which one corresponds to the cross-sectional dimensions of the follower finger and of which the other aperture is larger. Achieved hereby is the significant constructive advantage that the utilized components, such as swivel carriage, angle lever and housing, or connector plate can be used independently of the rotational driving direction of the drive shaft and the cylinder drum of the machine. With a change in the direction of rotation, the positions of the pressure recess and suction recess in the swivel carriage are to be exchanged and, in other words, the swivel carriage displaced by 180° relative to the rotational axis of the cylinder drum is inserted into the sliding guide. The inventive configuration now facilitates that, with the utilization of the same angle lever, the engagement for the setting movement is effected in the inventive manner at the correct location in which only the follower finger of the angle lever is effective which projects into the narrower aperture, in essence, conforming to its cross-sectional dimensions. The follower finger which projects into the larger aperture remains ineffective.

BRIEF DESCRIPTION OF THE DRAWINGS

Further advantageous embodiments of the invention may now be ascertained from the following description setting forth exemplary embodiments, taken in conjunction with the accompanying drawings; in which:

FIGS. 10 and 11 show two sectional views, offset relative to each other by 90°, of a dual-axial piston machine.

DETAILED DESCRIPTION

Figure 1:
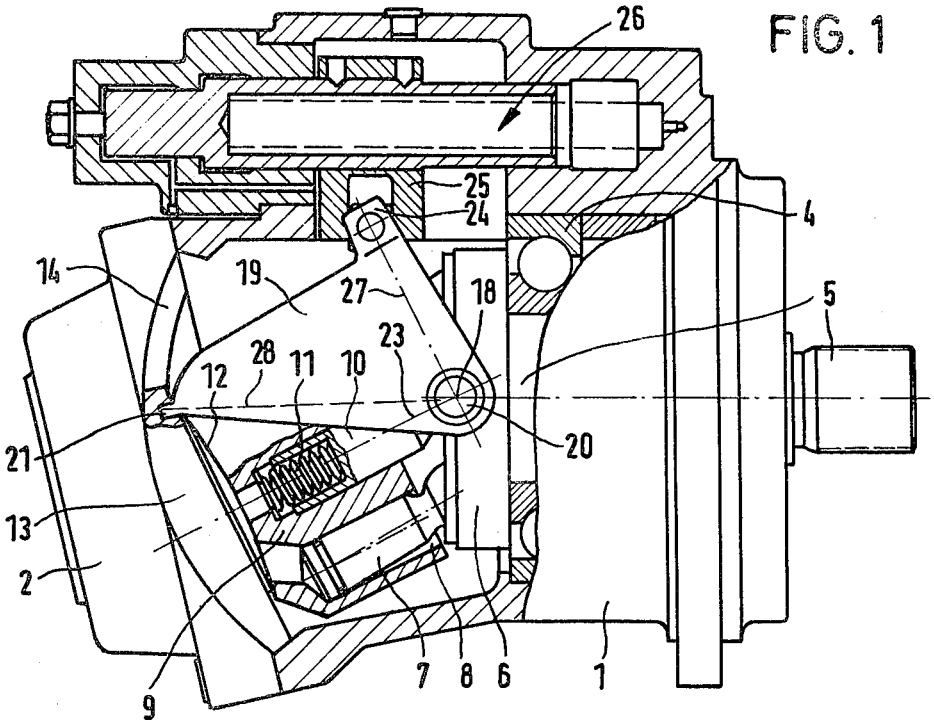
FIG. 1 illustrates in a partial section a side view of an axial piston machine.
Figure 2:
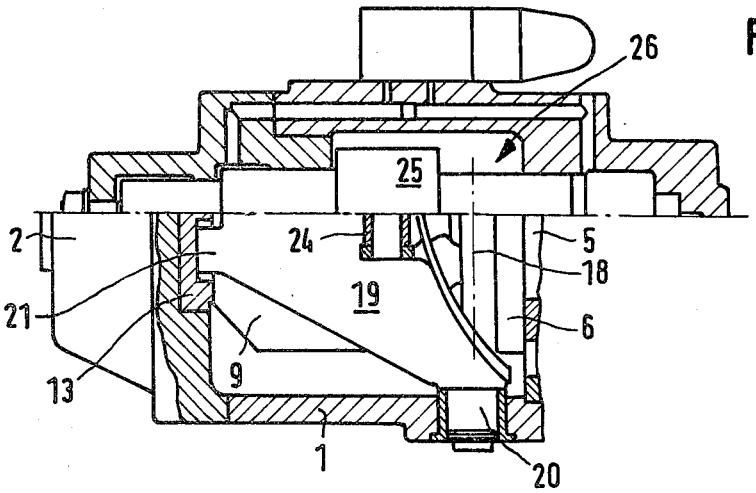
FIG. 2 shows two halves through different planes of horizontal sections of the axial piston machine of FIG. 1.

The axial piston machine according to FIGS. 1 through 9 encompasses a housing with a closure or collector plate 2 fastened thereto, a drive shaft 5 with a drive flange 6 which is supported through a bearing 4, in which pistons 7 are pivotally supported and which run in the cylinder bores 8 of a cylinder drum 9. The cylinder drum 9 is rotatably supported on a central trunion 10 which, in turn, is also pivotally supported on the drive disc 6 and against which there supports itself a spring 11 having its other end on the bottom of the bore in the cylinder drum 9 receiving the central trunion 10 and which presses the cylinder drum against the control member surface 12 of a swivel carriage 13. The swivel carriage 13, which is illustrated in detail in FIGS. 4 through 9, is displaceably conducted within a sliding guide 14 consisting of a cylindrical sleeve-shaped guide surface 15 and side guide surfaces 16 and 17 in the closure plate 2 (FIG. 3), so that the cylinder drum 9 can exert a pivotal movement about the pivot axis 18.

The pivotal movement of the swivel carriage 13 is effected through an angle lever 19 with two lever arms which, by means of trunions 20 within the housing 1, is supported to be pivotable about the pivot axis 18 of the cylinder drum 9. The angle lever 19 in the illustrated embodiment is shown as a tray member which at least partially encompasses the cylinder drum 9 and which includes follower fingers 21, 22 at the outer edge offset with reference to the rotational axis of the cylinder drum 9 axially from the pivot axis 18. At its outer surface located radially from the pivot axis 18 relatively to the rotational axis of the cylinder drum, the tray member angle lever 19 has a projection 24 against which there pivotally engages the setting element 25 of a mechanical, hydraulic or pneumatic transmitting apparatus 26 (not showing in detail) for the adjusting arrangement. The first and second lever arm of the angle lever 19 is illustrated by the phantom lines 27 and 28 in FIG. 1.

In FIGS. 3 through 9 there is more closely illustrated the swivel carriage 13, partly in its arrangement within the sliding guide 14. The swivel carriage 13 supports the control surface 12 with the suction-sided control recesses 30 and the pressure-sided control recesses 31. These are in communication with the suction-sided funnel 32 and the pressure-sided funnel 33 on the bottom side of the swivel carriage 13. Funnels 32 and 33 connect in each pivotal position of the swivel carriage either the suction-sided reniform recesses 30 or the pressure-sided reniform recesses 31 with the suction passageway 34 or, respectively, pressure passageway 35 in the collector plate 2.

Figures 3, 4, 5, 6, 7, 8, 9:
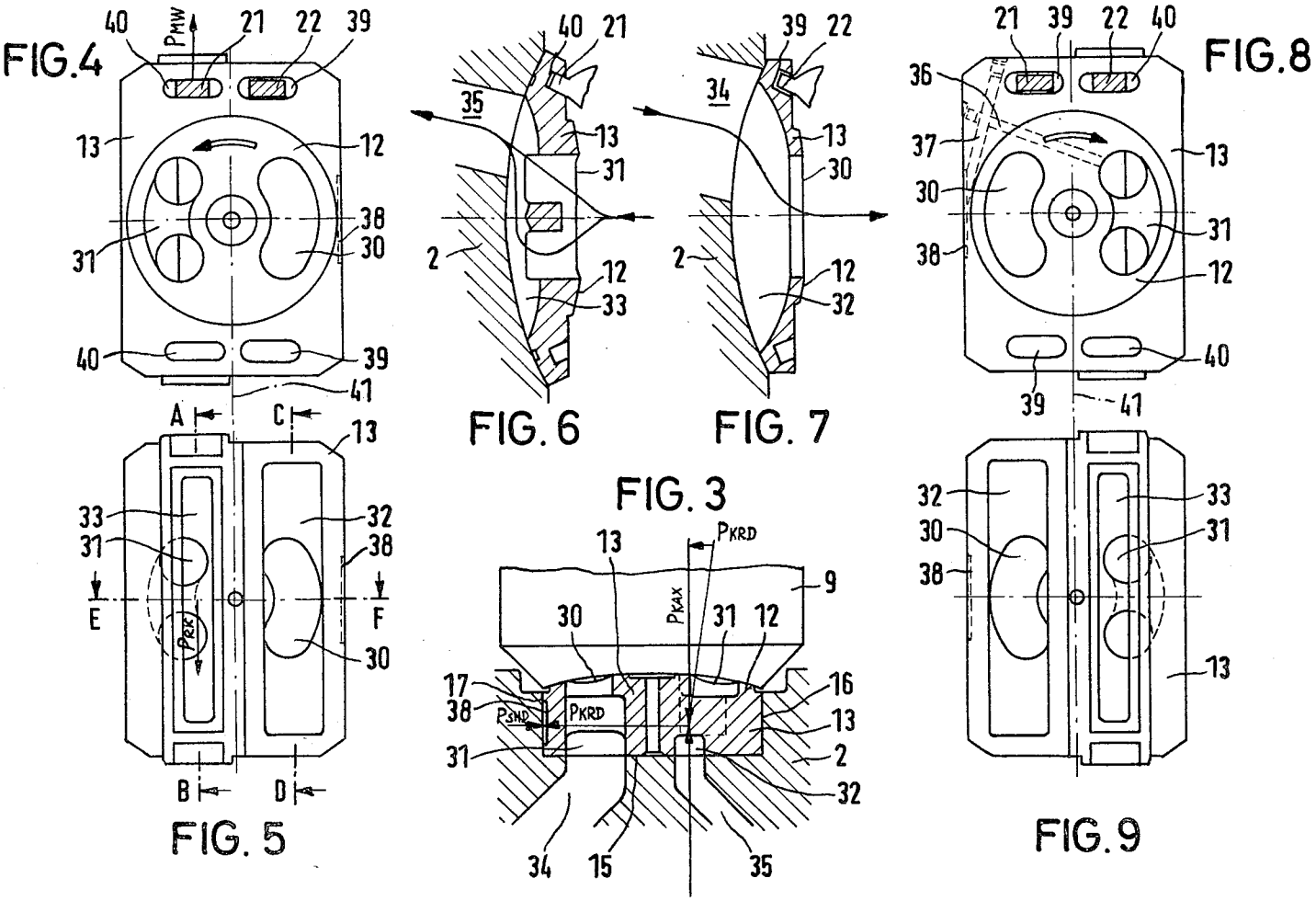
FIG. 3 is a cross-sectional view through the swivel carriage located within the sliding guide of the connector plate; as shown along section line E–F in FIG. 5.
FIG. 4 is an illustration of the swivel carriage as viewed from the side of the control surface for a counterclockwise rotation of the machine.
FIG. 5 is an illustration of the swivel carriage as in FIG. 4, as viewed from the side of the sliding guide.
FIG. 6 is a sectional view taken along line A–B in FIG. 5.
FIG. 7 is a sectional view taken along line C–D in FIG. 5.
FIG. 8 is an illustration of the swivel carriage viewed from the side of the control surface for a clockwise rotational direction of the machine.
FIG. 9 illustrates the swivel carriage pursuant to FIG. 8, as viewed from the side of the sliding guide.

The swivel carriage illustrated in FIGS. 8 and 9 corresponds to the swivel carriage described in the preceding figures, so that a further detailed description thereof is not required, and it is designated by the same reference numerals. The swivel carriage is merely inserted in a position reversed by 180° so that the then correspondingly changed direction of rotation of the cylinder drum 9 is indicated by the arrow marked "right", whereas in FIG. 4 the rotational direction is indicated by the arrow marked "left". Only in FIG. 8 are there indicated the passageways 36 and 37 within the swivel carriage 13, which lead from the high pressure-sided recesses 31 to a pressure area 38 located in the side surface of the swivel carriage 13.

On the upper surface, in effect, the side of the control surface 12, the swivel carriage 13, in the forward and rear side surfaces in the region of pivotal direction, includes, respectively, pairs of grooves 39, 40 into which, in accordance with the inserted position of the swivel carriage 13 (pursuant to FIG. 4 or according to FIG. 8), there engage the follower fingers 21, 22 of the angle lever 19. The pairs of grooves 39, 40 lie symmetrically relative to the central pivot plane 41 whereby the groove currently on the side of the pressure control recess 31 has a width which corresponds to the cross-sectional dimensions (in the shown instance being of a rectangular shape) of the follower fingers 21, 22, whereas the grooves 39 on the side of the control recesses 30 on the suction side from the pivotal central plane 41 have a larger width, so that the follower fingers 21 or respectively 22 can project with play, in essence, without any effect into the groove. This embodiment facilitates the selective positioning or insertion of the swivel carriage in the position pursuant to FIG. 4 or pursuant to FIG. 8 in accordance with the direction of rotation of the cylinder drum 9; nevertheless, the taking along is effected only through the follower finger 21 or 22 forwardly projecting over the groove 40 located on the pressure side in the pivoting direction (FIG. 4 and FIG. 8).

The previously described inventive construction assures that for the adjusting movement of the swivel carriage there will occur the minimum in frictional forces. The hydroforce $P_{THD}$ (FIG. 3) emanating from the high pressure funnel 33 lies in the same plane as the resultant axial force $P_{KAX}$ of the pistons 7 in the cylinder drum 9. Given hereby is an optimum unloading of the sliding guide 13, in particular of the guide surface 15. Due to the spherical construction of the control surface 12 there is produced a radial force $P_{KRD}$, which maintains itself in proportion to the operating pressure. This force presses the swivel carriage 13 against the side guide surfaces 17 of the closure or connector plate 2. In order to reduce the resultingly produced friction force which must be overcome by the adjusting arrangement 26, the swivel carriage 13 is provided with a high pressure-subjected unloading area 38. This will produce the force $P_{SHD}$ which eliminates the force $P_{KRD}$. The movement along of the swivel carriage 13 by the angle lever 19 (force $P_{MW}$; FIG. 4) follows precisely in the plane which is parallel with the pivotal central plane 41, in which there is produced the resultant friction force $P_{RK}$ between the swivel carriage 13 and the guide 14 in the collector plate 2.

In the embodiment pursuant to FIGS. 10 and 11 there is illustrated a dual-axial piston machine whereby the same components are provided with reference numerals increased by 100, and which need not again be explained. The angle lever 119 is also constructed tray-shaped and at least partially encompasses both cylinder drums 109, 109', and includes four follower fingers 121, 122 and 121' and 122'.

What is claimed is:

1. An axial piston machine having a variably inclined rotational axis, said machine comprising:

(a) a cylindrical drum pivotably mounted within a housing, said drum having a plurality of reciprocating pistons mounted therein;

(b) a drive shaft and flange member for rotating said cylindrical drum and reciprocating said pistons;

(c) a swivel carriage mounted for reciprocal movement in said housing, said swivel carriage displaceable from a first position aligned with said drive shaft to a second position angularly displaced from said shaft, said swivel carriage defining pressure and suction passageways that communicate with said pistons as said drum is rotated;

(d) a displaceable setting element mounted in said housing for controlling the angle of displacement for said swivel carriage between said first position and said second position;

(e) a tray shaped member supported by said housing on either side of said cylindrical drum to partially encompass said drum, said tray shaped member having a first projection engaging said swivel carriage along the outer edge of said carriage, said tray shaped member also including a second projection which engages said setting element for adjusting said carriage in response to movements of said setting element.

2. An axial piston machine as claimed in claim 1, which further includes a follower finger on the free end of said tray shaped member; and a groove formed in the region of the forward side of the swivel carriage, said follower finger projecting into said groove.

3. An axial piston machine as claimed in claim 1, which further comprises a pressure compensation means for compensation of the forces $P_{KRD}$ acting on the swivel carriage transverse to the pivoting direction and located on the suction passageway side of the swivel carriage, said pressure compensation means being connected with the pressure-sided control passageway through conduits in said swivel carriage.

4. An axial piston machine as claimed in claim 1, which further comprises a pressure compensation means for compensation of the forces $P_{KRD}$ acting on the swivel carriage transverse to the pivoting direction and located on the side of the suction passageway side of the swivel carriage, said pressure compensation means being connected with the pressure side control passageway through conduits in said swivel carriage.

5. An axial piston machine as claimed in claim 1, which further includes two follower fingers of identical cross-sectional dimensions on the free end of said second lever arm; said swivel carriage in the region of the forward and rearward side in the pivoting direction including two adjacent located apertures symmetrical to the central pivot plane and into which there engage said follower fingers, one of said apertures conforming to the cross-sectional dimensions of the follower finger and the other aperture being larger.

6. An axial piston machine as claimed in claim 5, wherein said apertures comprising grooves extend transverse to the pivoting plane, the larger groove being wider than the follower finger in the pivoting direction.

7. An axial piston machine having a variably inclined rotational axis, said machine comprising:

(a) a cylindrical drum pivotably mounted within a housing, said drum having a plurality of reciprocating pistons mounted therein;

(b) a drive shaft and flange member for rotating said cylindrical drum and reciprocating said pistons;

(c) a removable and invertable swivel carriage mounted in said housing, said carriage invertable from a first normal position to a second inverted position, said swivel carriage mounted for displaceable movement in said housing, said swivel carriage reciprocating from a first position aligned with said drive shaft to a second position angularly displaced from said shaft, said swivel carriage defining pressure and suction passageways that communicate with said pistons as said drum is rotated, said swivel carriage defining first and second pairs of grooves defined in said swivel carriage in alignment with said pressure and suction passageways, said first pair of grooves aligned with said pressure passageway having a first cross-sectional dimension, said second pair of grooves aligned with said suction passageway having a second and larger cross-sectional dimension;

(d) a displaceable setting element mounted in said housing for controlling the angle of displacement for said swivel carriage between said first position and said second position;

(e) a pivotal lever means having a pair of follower fingers with identical cross-sectional dimensions adapted to engage said swivel carriage, the cross-sectional dimensions of said follower fingers conforming to the first cross-sectional dimension defined by said swivel carriage, said lever means also defining means for engaging said setting element;

whereby the groove aligned with said pressure passage engages a follower finger aligned with said pressure passage in both said first normal position and said second inverted position of said swivel carriage.

8. An axial piston machine as claimed in claim 7, wherein said grooves extend transverse to the pivoting plane, the larger groove being wider than the follower finger in the pivoting direction.

9. An axial piston machine as claimed in claim 7, wherein said machine is a dual piston machine having two swivel carriages, said pivotal lever being a lever commonly encompassing two cylindrical drums and being shaped as a tray member, said tray member including a projection and at least 1 follower finger for each of said two swivel carriages.

10. An axial piston machine as claimed in claim 7, wherein said pivotal lever comprises a tray-shaped member supported in said housing on both sides of the cylindrical drum and at least partially encompasses the cylindrical drum, said member supporting the follower fingers at the outer edge, of said carriage said tray shaped member including a projection which is in engagement with the setting element.

11. An axial piston machine as claimed in claim 1, wherein said machine is a dual-piston machine having two swivel carriages, said angle lever being a lever commonly encompassing two cylindrical drums and being shaped as a tray member, said tray member including a projection and at least one follower finger for each of said two swivel carriages.

* * * * *